US006129293A

United States Patent [19]

Jäger

[11] Patent Number: 6,129,293

[45] Date of Patent: Oct. 10, 2000

[54] ROTARY NOZZLE HEAD

[76] Inventor: Anton Jäger, Dorfstrasse 9, Senden-Hittistetten, Germany, 89250

[21] Appl. No.: 09/013,870

[22] Filed: Jan. 27, 1998

[30] Foreign Application Priority Data

Jan. 28, 1997 [DE] Germany ..... 197 03 043

[51] Int. Cl.[7] ..... B05B 3/04

[52] U.S. Cl. ..... 239/227; 239/381; 239/237; 239/391; 239/437

[58] Field of Search ..... 239/253, 255, 239/261, 436, 439, 455, 237, 240, 381, 227, 391

[56] References Cited

U.S. PATENT DOCUMENTS 4,789,104 12/1988 Anderson ..... 239/455
5,328,097 7/1994 Wesch et al. ..... 239/261
5,551,635 9/1996 Jager ..... 239/40
5,722,592 3/1998 Jager ..... 239/227
5,896,871 4/1999 Larsen ..... 134/22.1

*Primary Examiner*—Kevin Weldon
*Attorney, Agent, or Firm*—Townsend and Townsend and Crew LLP

[57] ABSTRACT

A rotary nozzle head has a rotor nozzle (50) through which flow can take place, two radially adjustable sheet metal deflector plates (30, 32) and a nozzle bearing (42), the axial position of which is adjustable. An axially adjustable functional element carrier (20) is formed at its downstream end as an actuation housing (22) and has the nozzle bearing (42) at the upstream end thereof. In addition, the functional element carrier (20) supports the sheet metal deflector plates (30, 32).

23 Claims, 3 Drawing Sheets

ROTARY NOZZLE HEAD

The present invention relates to a rotary nozzle head comprising a rotor nozzle through which flow can take place, a nozzle bearing, the axial position of which is adjustable, and at least one radially adjustable deflector element.

DESCRIPTION OF PRIOR ART

A rotary nozzle head of this kind is known from DE 43 40 184A1 and is in particular used in high pressure cleaning apparatus. The known rotary nozzle head has a rotor nozzle through which flow can take place, and the front end of which contacts an axially adjustable nozzle bearing. By adjustment of the nozzle bearing a changeover can be made between a rotary nozzle operation, in which the rotor nozzle rotates, and an operation with a fixed jet, in which the rotor nozzle is fixed. Furthermore, the above named DE 43 40 184A1 describes a situation in which two sheet metal guides, which adjoin the rotary nozzle head, can be displaced radially inwardly in order to produce a flat jet.

OBJECT OF THE INVENTION

The object underlying the invention is to provide a rotary nozzle head of the initially named kind with a simple construction, which can be manufactured at favorable cost and in particular as a mass produced article, and which is also easy to assemble.

SUMMARY OF THE INVENTION

In order to satisfy this object, there is provided a rotary nozzle head of the initially named kind which is characterized by an axially adjustable functional element carrier, which is at least partly formed as an actuation housing, has the nozzle bearing and journals, or serves as a mounting for the deflector element.

Thus, in accordance with the invention, an axially adjustable functional element carrier is provided, which is formed at least partly as an actuation housing. The nozzle bearing is also provided on the functional element carrier, which simultaneously serves as a mounting for the deflector element.

The rotary nozzle head of the invention represents an extremely simple design, because all the important operational parts, namely the nozzle bearing and the deflector element, are arranged on a single component. Because the functional element carrier is axially adjustable and can be operated from the outside through its design as an actuation housing, the rotary nozzle head of the invention can also be changed over by simple actuating of the functional element carrier from the rotary nozzle operation to jet operation.

Advantageous embodiments of the invention are described in the specification and the figures.

Thus, in accordance with an advantageous embodiment of the invention, the deflector element can be secured via a pivot axis or axle to the functional element carrier, whereby the deflector element can be adjusted with a particular ease of movement.

It is in particular advantageous if two deflector elements are provided, which can be pivoted from a closed position in which they converge at an acute angle to one another into an open position, in which they diverge conically from their upstream spaced, apart ends to their downstream ends. In this embodiment a flat jet can be produced in the closed position of the deflector elements. In the open position, in rotary nozzle operation, a conical jet is, however, produced, because the deflector elements are spaced apart so far at their downstream ends that the conical jet produced by the rotary nozzle can emerge freely.

It is advantageous if the deflector elements contact one another, or almost contact one another, at their downstream ends in the closed position, because then a particularly pronounced flat jet emerges. It is also advantageous for the deflector elements to converge at a particularly acute angle, for example at an angle of approximately 5° to one another in the closed position. It has also proved to be advantageous if the mutual spacing of the deflector elements in the closed position has substantially the same order of magnitude as the downstream inner diameter of the rotor nozzle, since this leads to an excellent jet formation.

In accordance with a further advantageous embodiment of the invention, the functional element carrier is incorporated in a housing. In this way a particularly simple layout arises, because the rotary nozzle head consists of essentially two components, namely the housing and the functional element carrier. The rotary nozzle head of the invention is already finally assembled by insertion of the rotor nozzle into the housing and by pushing in the functional element carrier.

The housing preferably has a centering member for the upstream end of the rotor nozzle, whereby it is ensured that with the axially shifted functional element carrier the centering of the rotor nozzle takes place at the middle for jet operation. This centering piece can be formed in one piece with the housing or can be inserted into the housing as a separate part for manufacturing reasons.

The functional element carrier can be axially and linearly displaceable in the housing. It is, however, particularly advantageous for it to be axially displaceable in the housing by means of a rotary movement. In this way an axial adjustment of the functions element carrier can be produced by rotation of the actuation housing relative to the housing so that the nozzle bearing is also axially adjusted and releases or inhibits the movement of the rotor nozzle.

In accordance with a further embodiment of the invention, an abutment element fixed relative to the housing is provided, which inhibits an adjustment of the deflector element. In this way it is possible to prevent a situation in which, for example in jet operation, the closed deflector elements open through the jet pressure, because they abut against the abutment elements. Insofar as the functional element carrier has a cut-out complementary to the abutment element in the region of the deflector element, then it can be brought by axial displacement into a position in which the abutment element is arranged in the cut-out and thereby inhibits a movement of the deflector element. The abutment element can be connected to the housing in one piece or can be subsequently inserted into the latter for installation reasons. In the last named variant, the abutment element can simultaneously be used to secure the functional element carrier so that it is not lost from the housing in the operating state. The centering piece provided at the housing can have axial through-flow openings at the peripheral side. A conical surface having at least one groove can be provided at its downstream end. A swirl can be produced upstream of the centering piece through the throughflow openings at the peripheral side, which set the rotor nozzle in rotation. If the rotor nozzle is clamped, by axial adjustment of the functional element carrier, between the nozzle bearing and the centering piece, then the groove provided at the conical surface ensures that the liquid for the jet can also pass the rotor nozzle in this state.

It is particularly advantageous if the axial relative position between the function element carrier and the housing can be locked in preferably three positions In this way a flat jet can be set in one position, namely when the rotor nozzle is clamped between the centering piece and the nozzle bearing. When the deflector elements are slightly opened, a round jet can be produced and a conical jet is possible in rotary nozzle operation, with the deflector elements fully open. The round jet position can preferably be locked through the provision of a latch spigot.

In accordance with a further advantageous embodiment of the invention, the functional element carrier has a conical hollow cavity upstream of the nozzle bearing. In this way, the jacket surface of the rotor nozzle can roll off at this hollow cavity in its non-clamped state, whereby a stable operation is ensured. It is also advantageous if the functional element has, in the region of the nozzle bearing, a holding collar, into which the rotor nozzle with a ring groove provided at its downstream end can be inserted. In this way the rotor nozzle is always held at its downstream end in a defined position so that no undefined position of the rotor nozzle can occur, even on displacement of the functional element carrier.

If the functional element carrier has a conically opening or divergent hollow cavity downstream of the nozzle bearing, then the open deflector plate can be advantageously arranged in this hollow cavity so that the conical rotor nozzle jet can emerge unhindered from the rotary nozzle head.

It is also advantageous if the throughflow passage of the rotor nozzle has a constriction, because it is then ensured that the nozzle body is always pressed against the nozzle bearing when pressure fluid flows in.

The adjustment of the functional element carrier can be assisted in advantageous manner by a spring. In just the same way the opening of the deflector element can be assisted by a spring in addition to the pressure of the throughflowing liquid.

In accordance with a further advantageous embodiment of the invention, the functional element carrier can be formed at its downstream side as an actuation housing and can have the nozzle bearing upstream thereof. In this way a particularly compact design results.

The functional element carrier can also be of flexible design in the region of the rotor nozzle, whereby an influence can be effected on the rotor nozzle by adjustment of the functional element carrier. Thus, the functional element carrier can, for example, have radially adjustable lamella in the region of the rotor nozzle, which influence the rotary behavior of the rotor nozzle on displacement of the functional element carrier. It is particularly advantageous if the lamella are radially adjustable through positioning elements, which are arranged at the lamella or at a housing.

In accordance with a further embodiment, the functional element carrier can be formed essentially over its full axial length as an actuation housing, whereby the operating and handling is improved.

In a further embodiment of the invention an insert is rotatably and/or displaceably received within the functional element carrier and can preferably have a centering member for the upstream end of the rotor nozzle. In this embodiment the rotary nozzle head of the invention also consists of a few parts which can be simply manufactured and easily assembled.

At least one actuating element can be provided between the deflector element and the insert, whereby the deflector elements can be automatically actuated on a relative displacement between the insert and the functional element carrier.

The deflector element of the invention can also be additionally spring-loaded in order to assist opening or closing. Moreover, the deflector element can be formed as a sheet metal deflector plate or as a plastic component, which is lined in its inner region with a sheet metal inlay in order to prevent high wear.

BRIEF DESCRIPTION OF THE DRAWINGS

The invention will be described in the following purely by way of example, with reference to an advantageous embodiment and to the following drawings.

DESCRIPTION OF PREFERRED EMBODIMENTS

Figure 1:
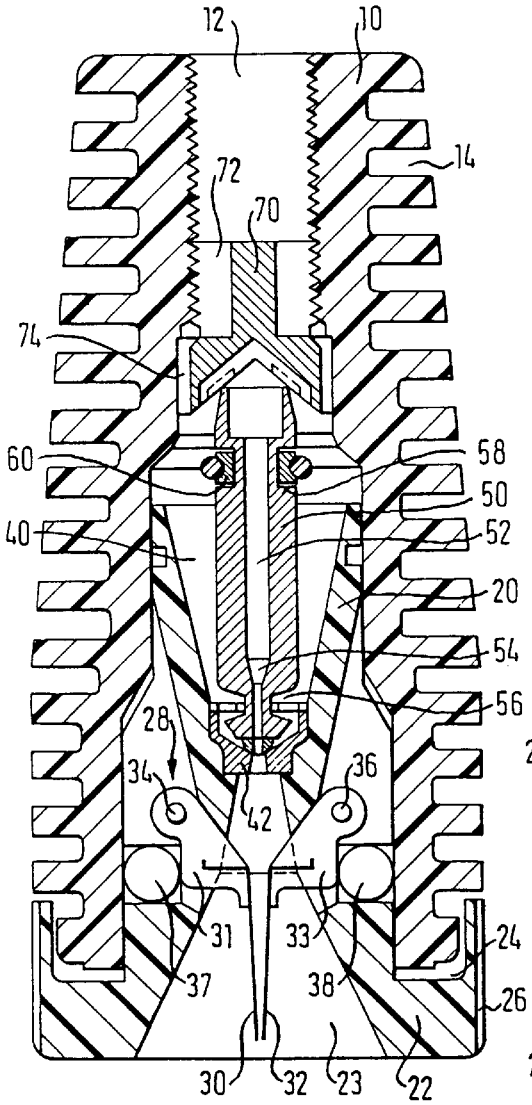
FIG. 1 is a cross-sectional view through a first embodiment of a rotary nozzle head in flat jet operation.
Figure 2:
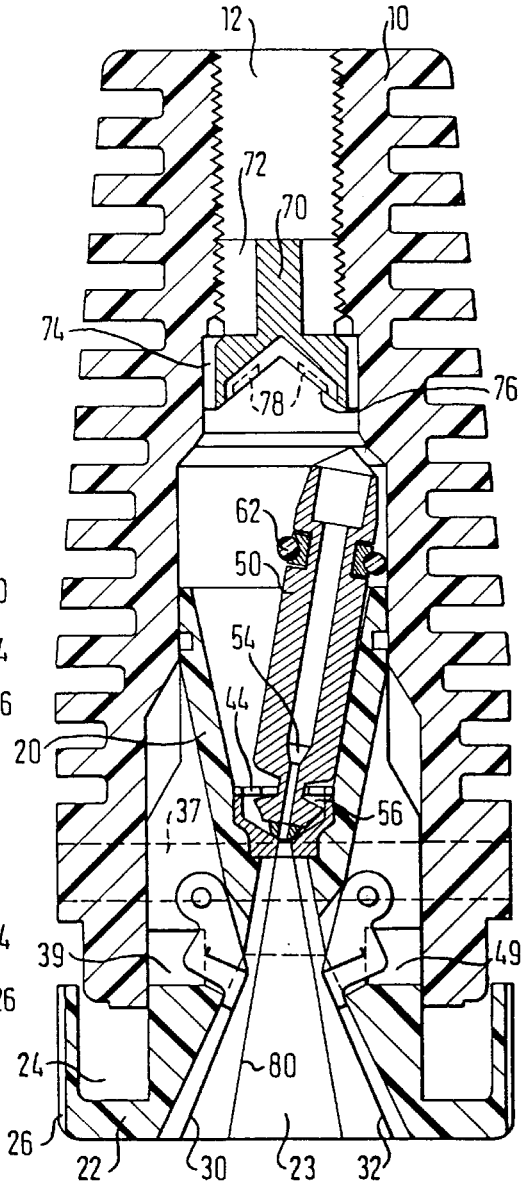
FIG. 2 is a cross-sectional view of the rotary nozzle head of FIG. 1 in rotary nozzle operation, wherein the housing 10 has been turned through 90° in comparison to FIG. 1.

The rotary nozzle head shown in FIGS. 1 and 2 has a housing 10 which has an upstream inflow opening 12 and also a downstream opening. Approximately one third of the housing 10 is cylindrical and tapers slightly conically following this to its upstream end. A plurality of parallel ring grooves 14 is molded into the outer side of the housing, which expediently consists of plastic. In this way material is saved, on the one hand. On the other hand, the housing 10 can also be reliably held.

A functional element carrier 20 is inserted into the housing 10 of the rotary nozzle head and is axially adjustable and displaceable relative to the housing 10. In this respect the functional element carrier 20 is formed at its downstream end as an actuation housing 22. The actuation housing 22 has the same outer diameter as the adjoining part of the housing 10, the downstream end of which is inserted into a ring groove 24 of the actuation housing 22. The outer wall of the actuation housing 22 at the peripheral side is provided with holding ribs 26, which make it easier to grasp it and rotate it.

A mounting section 28, on which two deflector elements 30, 32 in the form of sheet metal deflector plates or baffles are mounted about respective pivot axes 34, 36, adjoins the actuation housing 22 of the functional element carrier 20. Upstream of the pivot axes 34 and 36, the functional element carrier 20 is bell-shaped and forms a conical hollow cavity 40 with a nozzle bearing 42 being formed at the downstream apex point, the nozzle bearing itself being formed as a bowl-shaped bearing. Somewhat upstream of the nozzle bearing 42, a retaining collar 44 is molded onto the functional element carrier 20 (FIG. 2) and consists of flexible pins arranged in a star-like formation. A ring groove is provided in the region of the upstream end of the functional element carrier 20 and a non-illustrated O-ring is inserted into this ring groove in order to achieve sealing relative to the housing 10.

A rotor nozzle 50 is arranged in the rotary nozzle head and has a central throughflow passage 52. The throughflow passage 52 is broadened at its upstream end and has a constriction 54 in its downstream end. A ring groove 56 is provided downstream of the constriction 54 at the outer periphery of the rotor nozzle 50, and the retaining collar 44 of the functional element carrier 20 engages into the ring groove 56.

A ring groove 58 is provided in the upstream region of the rotor nozzle 50, and a bearing ring 60 is rotatably received in the ring groove 58. A resilient rolling ring 62 (FIG. 2) is located on the bearing ring and runs during rotary nozzle operation on the inner peripheral wall of the housing 10. A speed regulation is achieved through the arrangement of the bearing ring 60 and of the rolling ring 62.

A centering member 70 is provided in the housing 10 upstream of the rotor nozzle 50 and has axial throughflow openings 72, 74 at its peripheral side. These throughflow openings enable liquid flowing into the upstream opening 12 to flow through to the hollow space 40, which is formed between the functional element carrier 20, the inner space of the housing 10 and the centering piece 70. At its downstream end, the centering piece 70 has a conical surface 76, which is provided with a plurality of grooves 78 at its surface, with the grooves extending radially in the direction towards the apex point of the surface 76.

The deflector elements 30, 32 are hinged at the pivot axes 34 and 36 via hinge regions 31, 32, which are turned through 90° relative to the deflector elements. In their closed position, which is illustrated in FIG. 1, the two deflector elements 30, 32 converge at an acute angle in the direction of flow, a very small angle of the order of magnitude of 5°, and touch each other at their downstream ends in the pressure-less state. The mutual spacing of the upstream ends of the closed deflector elements 30, 32 corresponds substantially to the downstream internal diameter of the throughflow passage 52 of the rotor nozzle 50.

In the opened position, the two deflector elements 30, 32 are spaced substantially further apart at their upstream end than in the closed position and open from their upstream ends towards their downstream ends conically with an angle of opening of the order of magnitude of 45°. The upstream ends of the deflector elements are spaced apart sufficiently far that a conical jet 80 (FIG. 2) produced by the rotating rotor nozzle 50 is not hindered. For this purpose the actuation housing 22 of the functional element carrier 20 has a conically divergent hollow space 23, which enables a corresponding opening of the deflector plates 30, 32.

In the closed state of the deflector elements 30, 32 illustrated in FIG. 1, i.e. in flat jet operation, the pivot regions 31, 32 of the deflector plates 30, 32 each strike against cylindrical pin 37, 38, which prevents an opening movement of the deflector elements. In the open state of the deflector elements (FIG. 2) these are able to move freely because the cylindrical pins 37, 38 are not located in the cut-outs 39, 49 (FIG. 2) complementary thereto of the functional element carrier and thus enable an opening of the deflector elements.

In the following the manner of operation of the rotary nozzle head of the invention will be described and the flat jet operation will first be described in connection with FIG. 1.

For a flat jet operation the rotary nozzle head is brought into the position shown in FIG. 1, in which the functional element carrier 20 has been inserted as far as possible into the housing 10. In this state the rotary nozzle 50 is clamped between the conical surface 76 of the centering piece 70 and the nozzle bearing 42. At the same time the two deflector plates 30, 32 are closed. If now liquid, for example water, is introduced under pressure into the upstream inlet opening 12 of the rotary nozzle head, then it flows through the axial throughflow opening 72, 74 of the centering piece and fills the space outside of the rotor nozzle. Since the downstream end of the rotor nozzle 50 is sealed off relative to the nozzle bearing 42, no liquid can emerge at this point. With increasing pressure, the liquid thus flows through the grooves 78 in the conical surface 76 of the centering piece 70 and thus passes into the throughflow passage 52 of the fixed rotor nozzle.

At the downstream end of the rotor nozzle 50, the liquid emerges end enters between the two deflector elements 30, 32, which are, however, inhibited from an opening movement by the cylindrical pins 37, 38. In this way a flat jet arises at the outlet of the rotary nozzle head.

In order to change over the rotary nozzle head from flat jet operation to a rotary nozzle operation, the functional element carrier 20 is turned through 90° relative to the housing 10 by grasping the actuation housing 22 at the handling ribs 26 and rotating it. In this way the functional element carrier 20 is thrust axially outwardly relative to the housing by a non-illustrated guide. At the same time the cylindrical pins 37, 38 move away from the complementary cut-outs 39, 49 of the functional element carrier 20, whereby the deflector elements 30, 32 can open. This opening movement is additionally assisted by non-illustrated springs.

Since the functional element carrier 20 is made in one piece, the nozzle bearing 42 moves in the axial direction in the same manner as the actuation housing 22. In this way the rotor nozzle is freed and is held at its ring groove 56 by the holding collar 44 of the functional element carrier 20. If liquid is introduced under pressure into the rotary nozzle head in this state, then this liquid flows through the axial throughflow opening 72, 74 of the centering member 70. Through the special arrangement of these throughflow openings, a water swirl is produced downstream of the centering member 70 and sets the rotor nozzle 50 in rotation. At the same time, liquid flows through the throughflow channel 52 of the rotor nozzle 50, whereby a conical jet 80 results.

In an additional, non-illustrated operating position, in which the deflector elements 30, 32 are only slightly opened, for example by 1 to 2 mm, the rotary nozzle head of the invention can be used as around jet nozzle.

For the assembly of the nozzle, the functional element carrier 20 is first pre-assembled in that the two deflector elements 30, 32 are pivotally secured to the latter. In addition, the 0-ring is introduced into the upstream ring groove of the functional element carrier. The likewise pre-assembled rotor nozzle 50, i.e. the rotor nozzle 50 which is provided with the bearing ring 60 and the rolling ring 62, is subsequently pressed into the retaining collar 44, which yields flexibly. After the housing 10 has been provided with the centering member 70, it is now only necessary to push the pre-assembled functional element carrier 20 into the housing. The rotary nozzle head is now completely assembled by inserting the two cylindrical pins 37, 38, which are wedged into the housing 10.

Figure 3:
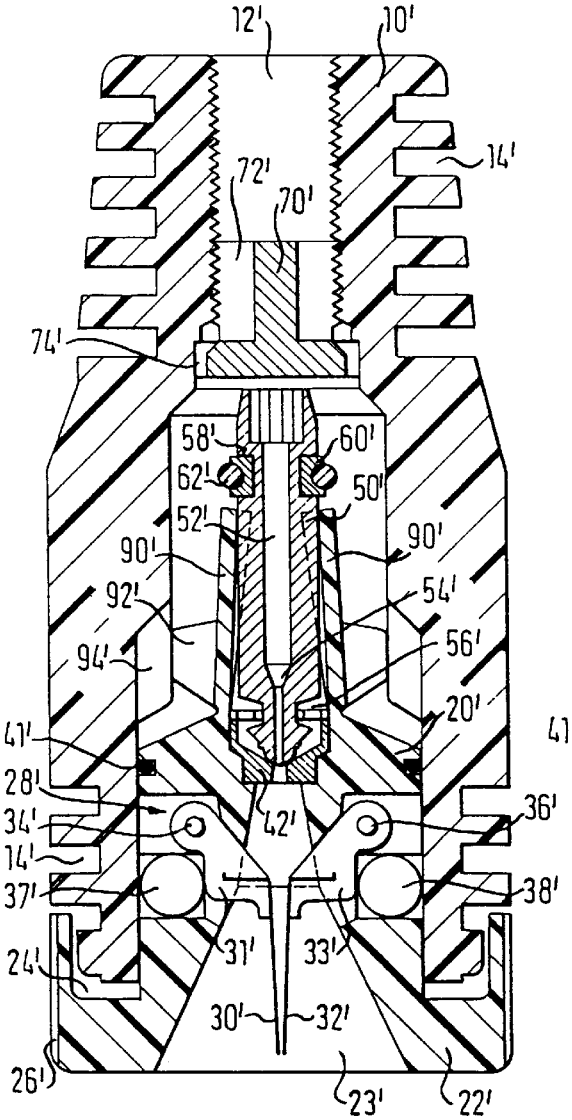
FIG. 3 is a cross-sectional view through a second embodiment of a rotary nozzle head in flat jet operation.
Figure 4:
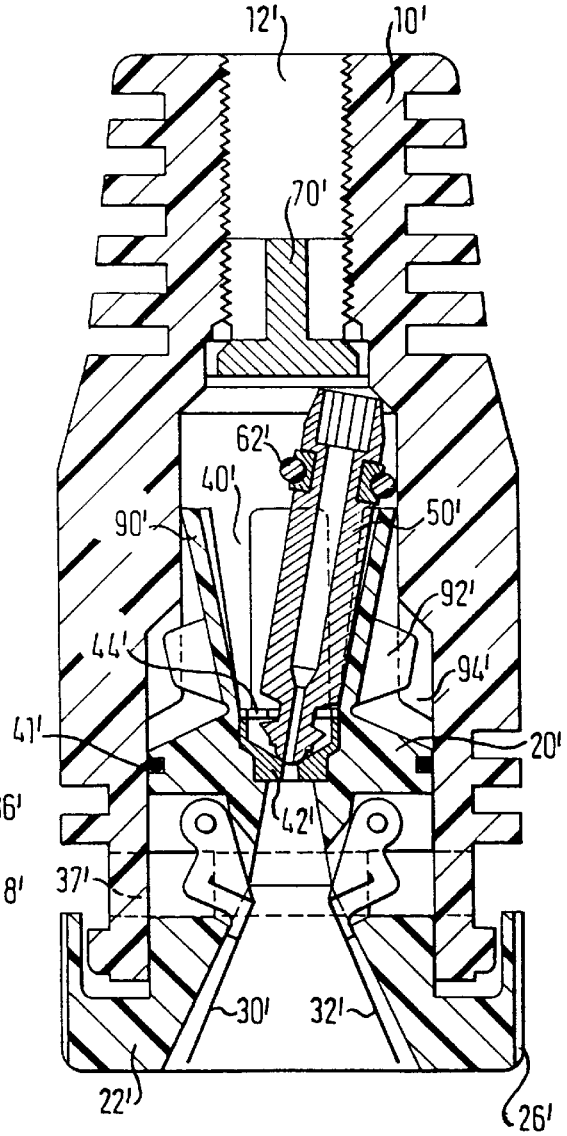
FIG. 4 is a cross-sectional view of the rotary nozzle head of FIG. 3 in rotary nozzle operation, with the housing 10' having been turned through 90° relative to FIG. 3.

A second embodiment of a rotary nozzle head is now shown in FIGS. 3 and 4, with the same or similar parts being provided with the same reference numerals with an additional dash.

The rotary nozzle head shown in FIGS. 3 and 4 has the housing 10' having an upstream inflow opening 12' and also a downstream opening. Approximately two; thirds of the housing 10' is made cylindrical and tapers slightly conically thereafter up to its upstream end. A plurality of parallel ring grooves 14' are molded both at the upstream end and at the downstream stream end into the outer side of the housing 10', which expediently consists of plastic.

A functional element carrier 20' is inserted into the housing 10' of this rotary nozzle head and is rotatable relative to the housing 10'. For this purpose the functional element carrier 20' is formed at its downstream end as an actuation housing 22'. The actuation housing 22' has the same outer diameter as the adjoining part of the housing 10', the downstream end of which is inserted into a ring groove 24' of the actuation housing 22'. The peripheral outer wall of the actuation housing 22 is provided with holding ribs 26', which facilitate grasping and rotation of the actuation housing.

A mounting section 28' adjoins the actuation housing 22' of the functional element carrier 22' and two deflector elements 30', 32' are journalled on the mounting section 28', in each case via a pivot axle 34', 36'. Upstream of the pivot axles 34', 36', the functional element carrier 20' broadens out up to the inner wall of the housing 10'. An O-ring 41' seals this position off between the functional element carrier 20' and the housing 10'.

Upstream of this region, the functional element carrier 20' is of flexible design and has radially adjustable lamella 90', onto which positioning noses 92' are molded. These positioning noses 92' contact a cam track guide 94' of the housing 10' in the position illustrated in FIG. 3. In the position illustrated in FIG. 4, the cam track guide 94' has been rotated relative to the positioning noses 92', so that the lamella 90' have opened as a result of their resilient spring force, whereby a bell-like region arises which forms a conical hollow space 40', with a nozzle bearing 42' being provided at its downstream apex point.

Somewhat upstream of the nozzle bearing 42', a holding collar 44' (FIG. 4) is molded onto the functional element carrier 20' and consists of flexible pins arranged in a star-like formation.

In the rotary nozzle head of FIGS. 3 and 4, there is provided a rotor nozzle 50', which has a central throughflow passage 52' (FIG. 3). The throughflow passage 52' is broadened out at its upstream end and has a constriction 54' (FIG. 3) in its downstream region. Downstream of the constriction 54' a ring groove 56' (FIG. 3) is provided at the outer periphery of the rotor nozzle 50' and the holding collar 44' (FIG. 4) of the functional element carrier 20' engages into the ring groove 56'. In the upstream region of the rotor nozzle 50' there is provided a ring groove 58' (FIG. 3) in which a bearing ring 60' is rotatably received. A resilient rolling ring 62' is located on the bearing ring and rolls on the inner peripheral wall of the housing 10' in rotor nozzle operation (FIG. 4). A speed regulation is achieved through the arrangement of the bearing ring 60' and of the rolling ring 62'.

An insert 70' is provided upstream of the rotor nozzle 50' in the housing 10' and has axial throughflow openings 72', 74' at its periphery. These throughflow openings enable liquid flowing into the upstream opening 12' to flow through to the hollow cavity 40' (FIG. 4), which is formed between the functional element carrier 20', the inner space of the housing 10' and the insert 70'.

The sheet metal deflector plates 30', 32' are pivotally connected to the pivot axes 34' and 36' via hinge regions 31', 33', which are turned through 90° relative to the deflector elements. In their closed position, which is illustrated in FIG. 3, the two deflector elements 30', 32' converge, at an acute angle in the direction of flow, at a very small angle of the order of magnitude of 5°, and touch each other in the pressure-less state at their downstream ends. The mutual spacing of the upstream ends of the closed deflector elements 30', 32' correspond substantially to the downstream internal diameter of the throughflow passage 52' of the rotor nozzle 50'. In other respects the design of the deflector elements corresponds to that of FIGS. 1 and 2.

In the closed state of the deflector elements 30', 32' shown in FIG. 3, i.e. in flat jet operation, the hinge regions 31', 33' of the deflector elements 30', 32' each abut against a respective cylindrical pin 37', 38', which prevents an opening movement of the deflector elements. In the opened state of the deflector elements (FIG. 4), the latter can move freely, because the cylindrical pins 37', 38' have been turned through 90° and thus no longer hinder a pivotal movement of the deflector elements.

In the following, the manner of operation of the rotary nozzle head will be described in connection with FIGS. 3 and 4 and the flat jet operation will first be explained in connection with FIG. 3.

For a flat jet operation, the rotary nozzle head is brought into the position shown in FIG. 3. In this position the rotor nozzle 50' is clamped by the lamella 90' of the functional element carrier 20' because the positioning noses 92' are pressed radially inwardly by the cam track guide 94' of the housing 10'. At the same time the two deflector elements 30', 32' are closed. If now a liquid, for example water, is introduced under pressure into the upstream inlet opening 12' of the rotary nozzle head, then this liquid flows through the axial throughflow opening 72', 74' of the insert 70' and fills the space outside of the rotor nozzle. Since the downstream end of the rotor nozzle 50' is sealed off relative to the nozzle bearing 42', no liquid can emerge at this point. With increasing pressure, the liquid thus flows into the throughflow passage 52' of the fixed rotor nozzle 50'.

At the downstream end of the rotor nozzle 50', the liquid emerges and passes between the two deflector elements 30', 32', which are, however, inhibited against an opening movement by the cylindrical pin 37', 38'. In this way a flat jet arises at the outlet of the rotary nozzle head.

In order to change over the rotary nozzle head from a flat jet operation to a rotor nozzle operation, the functional element carrier 20' is rotated through 90° relative to the housing 10' by grasping the actuation housing 22' at the holding ribs 26' and rotating it. In this way the deflector elements 30', 32' are no longer inhibited by the cylindrical pin 37', 38', whereby the deflector elements can open. This opening movement is additionally assisted by non-illustrated springs.

Through the relative rotation of the functional element carrier 20' and of the housing 10', the lamella 90' of the functional element carrier open, whereby the rotor nozzle 50' is released, but is held at its ring groove 56' by the retaining collar 44'. If, in this state, liquid is introduced under pressure into the rotary nozzle head, then this liquid flows through the insert 70' and a water swirl is produced downstream of the insert 70'. which sets the rotor nozzle 50' in rotation. At the same time, the liquid flows through the throughflow passage 52' of the rotor nozzle 50', whereby a conical jet results. In an additional, non-illustrated operating position in which the deflector elements 30', 32' are only slightly opened, for example by 1 or 2 mm, the rotary nozzle head of the invention can be used as a round jet nozzle.

The assembly of the nozzle takes place substantially, as was described for the first embodiment. In the following, a third embodiment of a rotary nozzle head will be described, which is shown in FIGS. 5 and 6.

Figure 5:
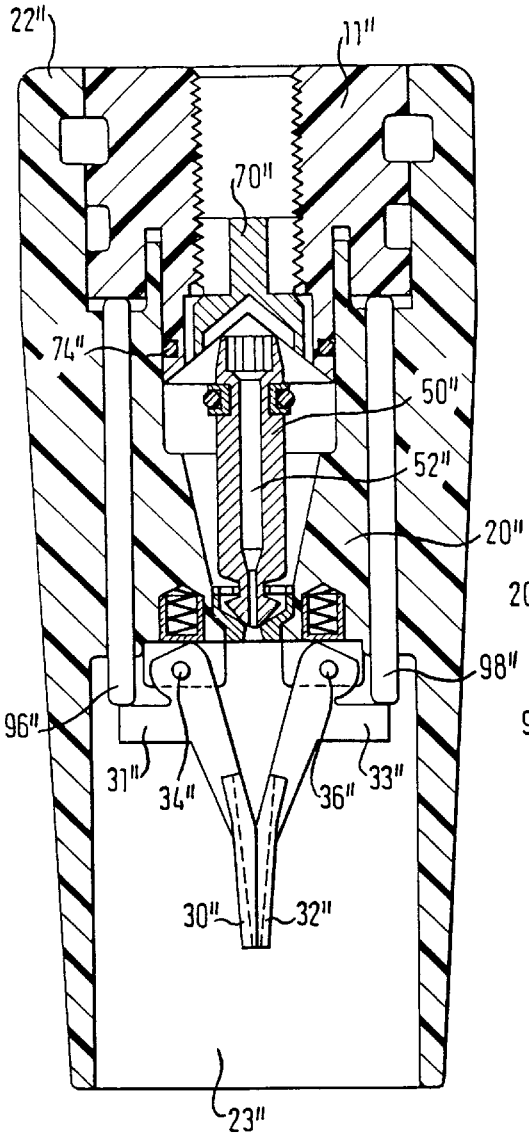
FIG. 5 is a cross-sectional view through a third embodiment of a rotary nozzle head in flat jet operation.
Figure 6:
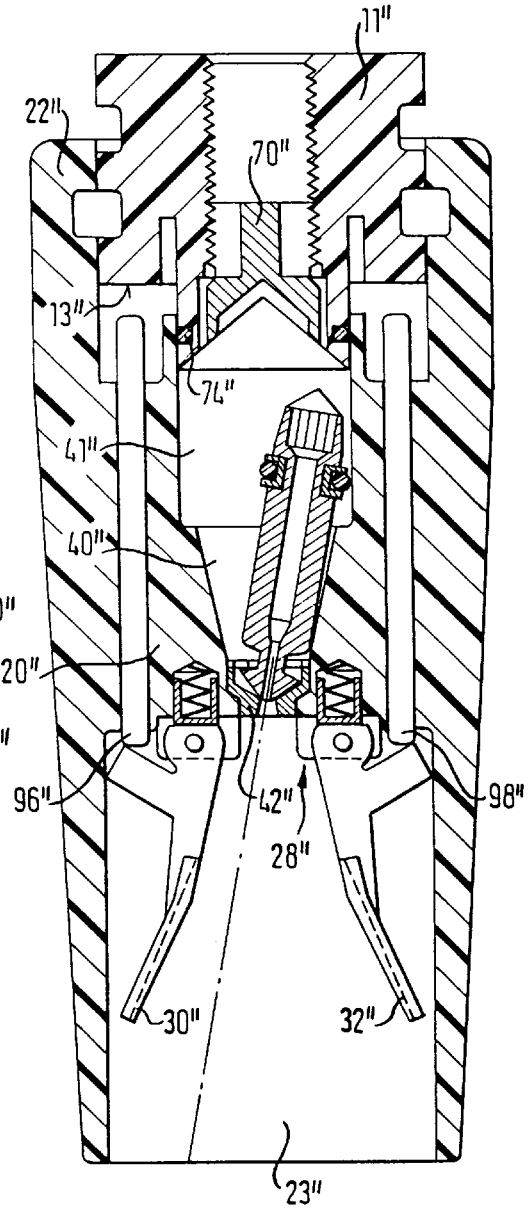
FIG. 6 is a cross-sectional view of the rotary nozzle head in FIG. 5 in rotary nozzle operation, with the insert 11" having been turned through 90° compared to FIG. 5.

The rotary nozzle head shown in FIGS. 5 and 6 has a functional element carrier 20", which is formed over its entire axial length as an actuation housing 22". The housing is of cylindrical shape at its upstream end and tapers over ca 80% of its length slightly conically in the direction of its downstream end. An insert 11" is inserted into the upstream end of the functional element carrier 20" and can be rotated relative to the functional element carrier and is axially displaced during this. An O-ring 74" between the insert 11" and the functional element carrier 20" serves as a seal this arrangement.

In the downstream third of the functional element carrier there is formed a cylindrical hollow space 23", which is adjoined by a mounting section 28", on which two deflector elements 30", 32" are journalled in each case via a pivot axle 34", 36" respectively. Upstream of the pivot axles 34" and 36", the functional element carrier 20" forms a bell-shaped or conical hollow space 40", which is adjoined at the upstream end by a cylindrical hollow space 41". A nozzle bearing 42" is provided at the lower apex point of the conical hollow space 40" and is again formed as a bowl-shaped bearing or dished bearing. Somewhat upstream of the nozzle bearing 42", there is located a retaining coder which is identical to that of the first two embodiments.

A rotor nozzle 50" is inserted into the rotary nozzle head and has a central throughflow passage 52". The remaining construction of the rotor nozzle is the same as that of FIGS. 1 to 4.

A centering member 70" is provided in the insert 11" upstream of the rotor nozzle 50" and is formed precisely in the same way as the centering member 70 of the first embodiment and serves the same purposes.

The deflector elements 30", 32" are pivotally connected at the pivot axles 34" and 36" via hinge regions 31", 33", which are turned through 90° relative to the deflector elements. Actuating projections, on which actuating pins 96", 98" can act (FIG. 6) in order to actuate the deflector elements, are formed in one piece with the hinge regions 31", 33". The actuating pins 96", 98" extend in corresponding bores of the functional element carrier 22" and are arranged parallel to the direction of flow. The upstream ends of the actuating pins 96", 98" can enter into engagement with the abutment surface 13" of the insert 11", whereby the actuating pins can be pushed axially in the flow direction through the functional element carrier 20" and close the deflector elements 30", 32" for flat jet operation. During this, the lower sides of the hinge regions 31", 33" press against two springs which are arranged in blind bores of the functional element carrier.

In the closed state of the deflector elements 30', 32', which are illustrated in FIG. 5, i.e. in flat jet operation, the actuating pins 96', 98' abut against the projections of the hinge regions 31", 32" of the deflector elements. At the same time, the upstream ends of the actuating pins are hindered from an axial movement by the insert 11". In this way an opening movement of the deflector elements is prevented. In the open state of the deflector elements (FIG. 6), these are pressed radially outwardly by the associated springs, whereby these springs press the associated actuating pins axially rearwardly opposite to the flow direction. Since the abutment surface 13" of the insert 11" has moved axially away from the functional element carrier 20" opposite to the flow direction as a result of the relative rotary movement between the insert 11" and the functional element carrier 20", the upstream ends of the actuating pins no longer contact the insert 11".

The manner of operation of this embodiment of a rotor nozzle corresponds fundamentally to that of the first embodiment of FIGS. 1 and 2. In order to change over the rotary nozzle heed of FIGS. 5 and 6 from a flat jet operation to a rotor nozzle operation, the functional element carrier 20", i.e. the housing 22" connected in one piece with it, is rotated through 90° relative to the insert 11". In this way the insert 11" and the functional element carrier 20" are displaced relative to one another in the axial direction. At the same time the upstream ends of the actuating pins 96", 98" become free from the abutment surface 13" of the insert 11", whereby the deflector elements 30", 32" can open assisted by the spring force of the associated springs.

In this embodiment only a small opening of the deflector elements 30", 32" can be achieved in an additional, non-illustrated operating position, whereby the rotary nozzle head can be used as a round jet nozzle.

Both the housings 10, 10' and also the functional element carriers 20, 20'. 20" are formed in one piece and are manufactured of plastic. The deflector elements consist of metal but can, however, also be manufactured of other material.

What is claimed is:

1. Rotary nozzle head comprising a rotor nozzle through which flow can take place, a nozzle bearing, at least one radially adjustable deflector element, and a functional element carrier which is at least partly formed as an actuation housing, supports the nozzle bearing, and serves as a mounting for the deflector element.

2. Apparatus in accordance with claim 1 including a pivot axle securing the deflector element to the functional element carrier.

3. Apparatus in accordance with claim 1 including two deflector elements which are pivotable from a closed position, in which they converge at an acute angle into an opened position, in which they open divergingly from their spaced-apart upstream ends to their downstream ends.

4. Apparatus in accordance with claim 3 wherein the mutual spacing of the downstream ends of the deflector elements in the closed position has substantially the same order of magnitude as the downstream inner diameter of the rotor nozzle.

5. Apparatus in accordance with claim 1 including a housing, the functional element carrier being received in the housing, and a centering member in the housing for an upstream end of the rotor nozzle.

6. Apparatus in accordance with claim 5 wherein the functional element carrier is axially displaceable within the housing by rotationally moving the housing.

7. Apparatus in accordance with claim 5 including an abutment element fixed relative to the housing inhibiting an adjustment of the deflector element.

8. Apparatus in accordance with claim 7 wherein the functional element carrier has a cut-out in a region of the deflector element which is complementary to the abutment element.

9. Apparatus in accordance with claim 1 including a centering member having axial throughflow openings at its periphery and a conical surface at its downstream end which includes at least one groove.

10. Apparatus in accordance with claim 1 wherein the functional element carrier forms a conical hollow space upstream of the nozzle bearing.

11. Apparatus in accordance with claim 1 wherein the functional element carrier has a retaining collar in a region of the nozzle bearing, and wherein the rotor nozzle has a ring groove in its downstream region.

12. Apparatus in accordance with claim 1 wherein the functional element carrier has a hollow cavity downstream of the nozzle bearing, and wherein the deflector plate is arranged in the hollow cavity.

13. Apparatus in accordance with claim 1 wherein the rotor nozzle includes a throughflow passage with a constriction.

14. Apparatus in accordance with claim 1 wherein the functional element carrier is flexible in a region of the rotor nozzle.

15. Apparatus in accordance with claim 14 wherein the functional element carrier has radially adjustable lamella in a region of the rotor nozzle.

16. Apparatus in accordance with claim 15 including a housing and positioning elements arranged at the housing for radially adjusting the lamella.

17. Apparatus in accordance with claim 1 including an insert displaceably received in the functional element carrier and having a centering piece for an upstream end of the rotor nozzle.

18. Apparatus in accordance with claim 17 including at least one actuating element provided between the deflector element and the insert.

19. Apparatus in accordance with claim 1 wherein the deflector element is spring loaded.

20. Apparatus in accordance with claim 1 wherein the functional element carrier is formed in one piece.

21. Apparatus in accordance with claim 1 wherein the functional element carrier is axially adjustable.

22. Apparatus in accordance with claim 1 wherein the axial position of the nozzle bearing is adjustable.

23. Apparatus according to claim 1 including a sheet metal inlay lining the deflector element.

* * * * *